US009240170B2

(12) United States Patent
Chekardzhikov

(10) Patent No.: US 9,240,170 B2
(45) Date of Patent: Jan. 19, 2016

(54) VIBRATION-SENSING STRINGED INSTRUMENT MOUNTABLE DEVICE

(71) Applicant: Petar Chekardzhikov, Fullerton, CA (US)

(72) Inventor: Petar Chekardzhikov, Fullerton, CA (US)

( * ) Notice: Subject to any disclaimer, the term of this patent is extended or adjusted under 35 U.S.C. 154(b) by 282 days.

(21) Appl. No.: 13/692,870

(22) Filed: Dec. 3, 2012

(65) Prior Publication Data

US 2014/0150627 A1 Jun. 5, 2014

(51) Int. Cl.

| | |
|---|---|
| ***G10G 7/02*** | (2006.01) |
| ***G10D 3/14*** | (2006.01) |
| ***G10D 9/00*** | (2006.01) |
| ***G10H 1/44*** | (2006.01) |
| ***G10G 7/00*** | (2006.01) |

(52) U.S. Cl.

CPC .. *G10G 7/02* (2013.01); *G10D 3/14* (2013.01); *G10D 9/00* (2013.01); *G10G 7/00* (2013.01); *G10H 1/44* (2013.01)

(58) Field of Classification Search

CPC ..... G10G 7/02; G10G 7/00; G10D 9/00; G10D 3/14; G10H 1/44

USPC ..... 84/453, 454, 455

See application file for complete search history.

(56) References Cited

U.S. PATENT DOCUMENTS

| | | | | | |
|---|---|---|---|---|---|
| 3,496,297 | A * | 2/1970 | Brumberger | G10H 3/146 | 248/362 |
| 4,365,537 | A * | 12/1982 | Pogoda | G10D 3/163 | 84/320 |
| 4,569,077 | A * | 2/1986 | Marinelli | G10K 11/004 | 310/328 |
| 4,899,636 | A * | 2/1990 | Chiba | B06B 1/06 | 381/114 |
| 5,388,496 | A * | 2/1995 | Miller | G10G 7/02 | 324/76.11 |
| D378,683 | S * | 4/1997 | Ridinger | D10/102 | |
| 5,631,426 | A * | 5/1997 | Jao | G01H 1/00 | 73/587 |
| 5,637,820 | A * | 6/1997 | Wittman | G10D 1/085 | 84/327 |
| 5,728,959 | A * | 3/1998 | O'Rorke | G10G 7/02 | 248/205.2 |
| 5,877,444 | A * | 3/1999 | Hine | G10G 7/02 | 84/454 |
| 6,291,755 | B1 * | 9/2001 | Hine | G10G 7/02 | 84/454 |
| 6,465,723 | B2 * | 10/2002 | Milano | G10G 7/02 | 84/274 |
| 6,797,872 | B1 * | 9/2004 | Catalano | G10G 7/02 | 84/453 |
| 6,965,067 | B2 * | 11/2005 | Kondo | G10G 7/02 | 84/454 |
| 7,049,502 | B2 * | 5/2006 | Taku | G10G 7/02 | 84/454 |
| 7,074,998 | B2 * | 7/2006 | Hurwicz | G10G 7/02 | 84/454 |
| 7,265,282 | B2 * | 9/2007 | Membreno | G10G 7/02 | 84/453 |
| 7,285,710 | B1 * | 10/2007 | Wallace | G10G 7/02 | 84/454 |

(Continued)

FOREIGN PATENT DOCUMENTS

| | | |
|---|---|---|
| CN | 202228523 | 5/2012 |
| JP | 2005-091710 | 4/2005 |

(Continued)

OTHER PUBLICATIONS

International Search Report and Written Opinion of the International Searching Authority (for a PCT application containing similar claims to the current application).

*Primary Examiner* — David Warren

*Assistant Examiner* — Christina Schreiber

(74) *Attorney, Agent, or Firm* — Superior IP, PLLC; Dustin L. Call

(57) ABSTRACT

A stringed instrument mountable device. The stringed instrument mountable device includes a vibration sensing device configured to detect a note being played on a stringed instrument. The stringed instrument mountable device also includes an attachment configured to attach the vibration sensing device to the stringed instrument.

17 Claims, 5 Drawing Sheets

(56) References Cited

U.S. PATENT DOCUMENTS

| | | | | |
|---|---|---|---|---|
| 7,390,951 | B2 * | 6/2008 | Dulaney | G10G 7/02 84/454 |
| 7,531,732 | B2 | 5/2009 | Dunlop | |
| 7,709,720 | B1 * | 5/2010 | Shippey | G10D 3/14 84/327 |
| 7,723,595 | B2 | 5/2010 | Dunlop | |
| 7,818,078 | B2 * | 10/2010 | Iriarte | G10H 1/0083 700/94 |
| 7,875,784 | B2 * | 1/2011 | Moyle | G10G 7/02 84/329 |
| 7,960,636 | B2 * | 6/2011 | Demsey | G10H 1/40 84/455 |
| 8,173,881 | B1 * | 5/2012 | Schenk | G10D 1/005 84/312 R |
| 2003/0169377 | A1 * | 9/2003 | Kulas | G10G 7/02 349/1 |
| 2004/0159225 | A1 | 8/2004 | Barr | |
| 2007/0006716 | A1 * | 1/2007 | Salmond | G10G 7/02 84/600 |
| 2013/0074677 | A1 * | 3/2013 | D'Addario | G10D 3/14 84/455 |

FOREIGN PATENT DOCUMENTS

| | | |
|---|---|---|
| JP | 2011053423 | 3/2011 |
| KR | 10-2005-0074230 | 7/2008 |

* cited by examiner

VIBRATION-SENSING STRINGED INSTRUMENT MOUNTABLE DEVICE

CROSS-REFERENCE TO RELATED APPLICATIONS

Not applicable.

BACKGROUND OF THE INVENTION

Digital tuners allow user to easily tune stringed instruments, such as guitars. In particular, the digital tuner can provide an easy to understand display which allows the user to quickly determine the note being played and tune the stringed instrument so that the note produced is the note intended by the user.

However, these digital tuners suffer from a number of drawbacks. For example, they must be close to the stringed instrument in order to produce an accurate reading. If it is not sufficiently close, then the digital tuner will be unable to measure the note properly and tuning the stringed instrument will become difficult or impossible. However, this means that either the user is holding the tuner or balancing it closely to the stringed instrument. Neither is desirable because neither replicates normal play positions by the user.

Some users clip the digital tuner to the headstock on the stringed instrument to ensure proximity. However, this is often a temporary solution at best as the clip must be removed before transport. In addition, the clip and tuner are visible to the audience so it is not aesthetically pleasing to leave on during a performance. Further, the clip can ruin the finish of the stringed instrument while being used, placed or removed. Finally, the clip can cause an undesired "buzz" if it vibrates relative to the headstock.

Accordingly, there is a need in the art for a system that can attach a digital tuner to an instrument at locations other than the headstock. Additionally, there is a need in the art for the system to be capable of attachment for long periods of time, such as during transportation of the instrument. Further, there is a need in the art for the system to accurately transfer vibration to the tuner. Moreover, there is a need in the art for a system that can attach inconspicuously to the instrument, so that it is not obtrusive and distracting for the audience during a performance. Also, there is a need in the art for a system that would attach to instruments where a clip cannot be attached.

BRIEF SUMMARY OF SOME EXAMPLE EMBODIMENTS

This Summary is provided to introduce a selection of concepts in a simplified form that are further described below in the Detailed Description. This Summary is not intended to identify key features or essential characteristics of the claimed subject matter, nor is it intended to be used as an aid in determining the scope of the claimed subject matter.

One example embodiment includes a stringed instrument mountable device. The stringed instrument mountable device includes a vibration sensing device configured to detect a note being played on a stringed instrument. The stringed instrument mountable device also includes an attachment configured to attach the vibration sensing device to the stringed instrument.

Another example embodiment includes a stringed instrument mountable device. The stringed instrument mountable device includes a vibration sensing device configured to detect a note being played on a stringed instrument. The stringed instrument mountable device also includes an attachment. The attachment includes a flexible plate configured to releasably secure the vibration sensing device to the stringed instrument. The attachment also includes a knob configured to move a portion of the flexible plate relative to the surface of the stringed instrument. The attachment further includes a release configured to allow air into the inside of the flexible plate, preventing attachment.

Another example embodiment includes a stringed instrument mountable device. The stringed instrument mountable device includes a vibration sensing device configured to detect a note being played on a stringed instrument. The stringed instrument mountable device also includes an attachment. The attachment includes a flexible plate configured to releasably secure the vibration sensing device to the stringed instrument. The attachment also includes a knob configured to move a portion of the flexible plate relative to the surface of the stringed instrument. The attachment further includes a release configured to allow air into the inside of the flexible plate, preventing attachment. The attachment additionally includes a swivel. The swivel is configured to allow the orientation of the vibration sensing device to be changed relative to the stringed instrument. The swivel is also configured to attach to the vibration sensing device and attach to the flexible plate.

These and other objects and features of the present invention will become more fully apparent from the following description and appended claims, or may be learned by the practice of the invention as set forth hereinafter.

BRIEF DESCRIPTION OF THE DRAWINGS

To further clarify various aspects of some example embodiments of the present invention, a more particular description of the invention will be rendered by reference to specific embodiments thereof which are illustrated in the appended drawings. It is appreciated that these drawings depict only illustrated embodiments of the invention and are therefore not to be considered limiting of its scope. The invention will be described and explained with additional specificity and detail through the use of the accompanying drawings in which.

DETAILED DESCRIPTION OF SOME EXAMPLE EMBODIMENTS

Reference will now be made to the figures wherein like structures will be provided with like reference designations. It is understood that the figures are diagrammatic and schematic representations of some embodiments of the invention, and are not limiting of the present invention, nor are they necessarily drawn to scale.

Figure 1:
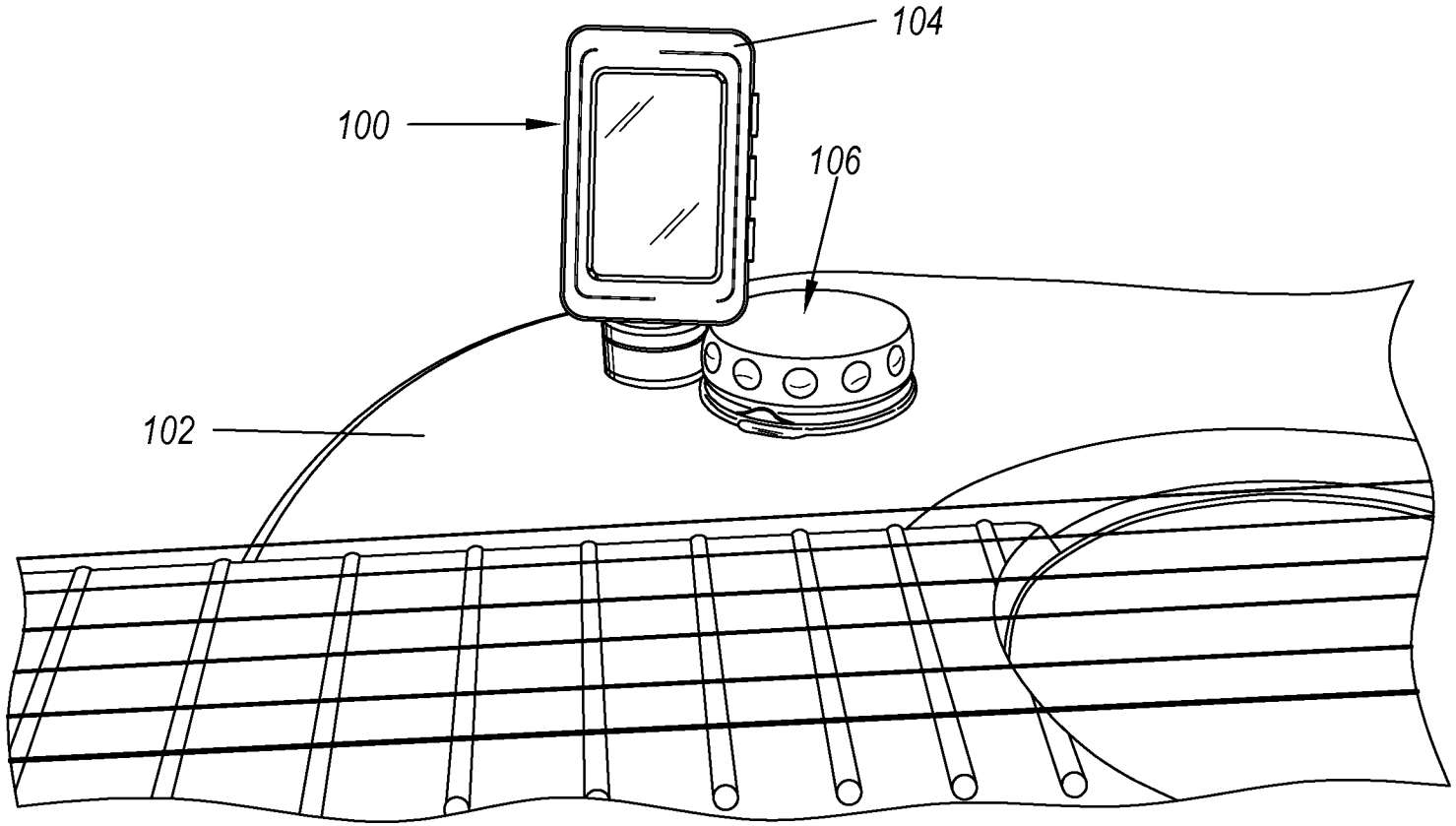
FIG. 1 illustrates an example of a stringed instrument mountable tuner.

FIG. 1 illustrates an example of a stringed instrument mountable tuner 100. The stringed instrument mountable tuner 100 can attach to any desired location during use. For example, the stringed instrument mountable tuner 100 can attach to the headstock, the soundboard, on the side next to the heel or any other desired location. Additionally or alternatively, the stringed instrument mountable tuner 100 can be left in place during use. I.e., the attachment strength can be sufficient that the stringed instrument mountable tuner 100 need not be removed during use of the instrument.

FIG. 1 shows that the stringed instrument mountable tuner 100 can be attached to a stringed instrument 102. For example, the stringed instrument mountable tuner 100 can be attached to a guitar, sitar, rabab, electric bass, violin, viola, cello, double bass, banjo, mandolin, ukulele, bouzouki, harp or any other desired string instrument. E.g., a guitar is a plucked string instrument, played either with fingers or a pick. The guitar includes of a body with a rigid neck to which the strings, generally six in number but sometimes more or less, are attached. The guitar can be constructed of various woods and strung with animal gut or with either nylon or steel strings. As used herein, the guitar can include both acoustic and electric guitars.

FIG. 1 shows that the stringed instrument mountable tuner 100 can include a digital tuner 104. The digital tuner 104 can detect the vibrations from the stringed instrument 102 and determine the note played by the stringed instrument 102. I.e., the digital tuner 102 can display the note played by the stringed instrument, allowing a user to adjust the stringed instrument 102 to be properly tuned. For example, the digital tuner 104 can include a backlit color LCD display or touch-screen display. Additionally or alternatively, the digital tuner 104 can include a piezoelectric sensor. A piezoelectric sensor is a device that uses the piezoelectric effect to measure pressure, acceleration, strain or force by converting them to an electrical charge. This can be converted to a frequency or note being played and/or can be amplified during play.

FIG. 1 also shows that the stringed instrument mountable tuner 100 can include an attachment 106. The attachment 106 can be configured to attach the digital tuner 104 to the stringed instrument 102. Attaching the digital tuner 104 to the stringed instrument 102 can allow the digital tuner 104 to more accurately detect the correct note played by the stringed instrument 102. Additionally or alternatively, the attachment 106 can ensure that the digital tuner 104 is available to the user when desired. I.e., the attachment 106 can allow the digital tuner 104 to be moved with the stringed instrument 102.

Figure 2:
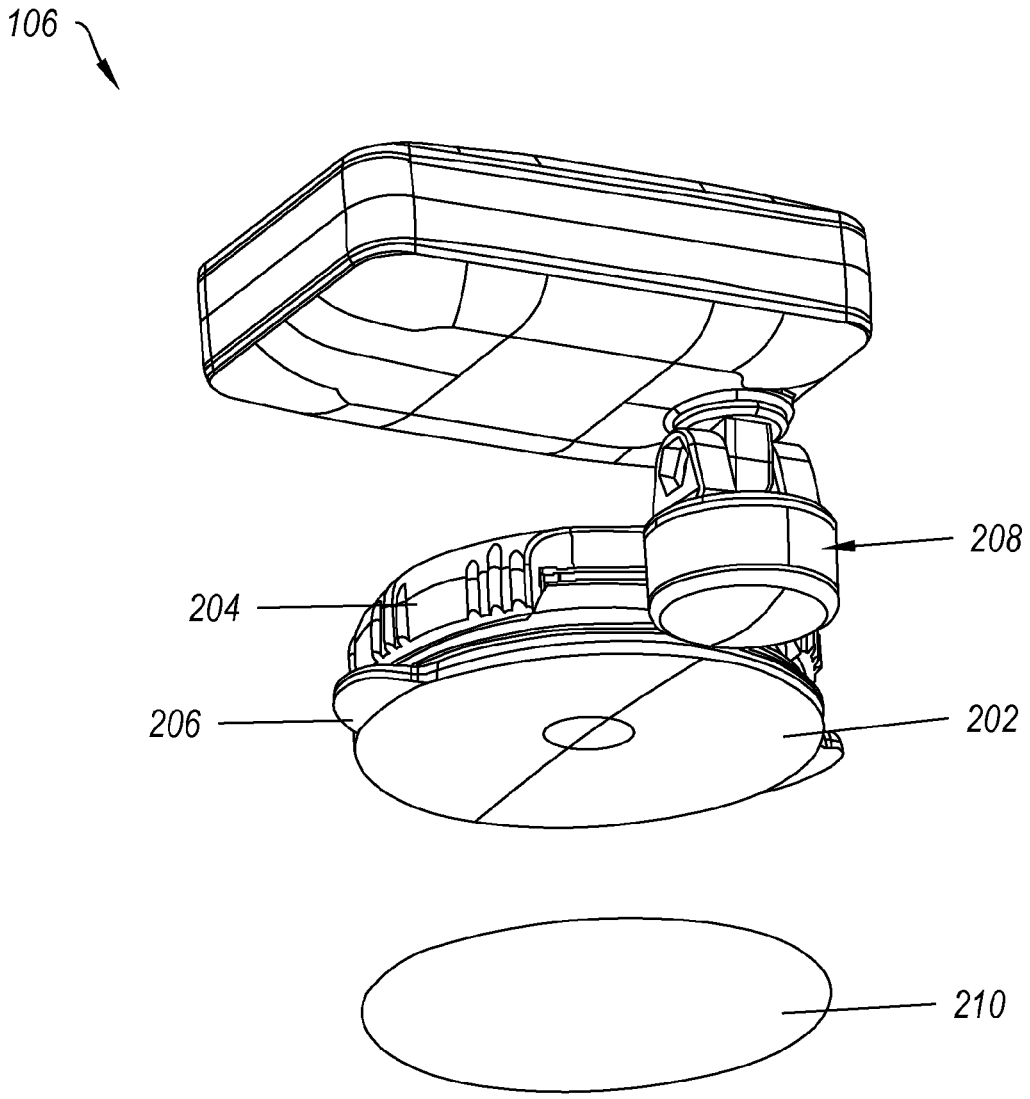
FIG. 2 illustrates an example of an attachment.

FIG. 2 illustrates an example of an attachment 106. The attachment 106 can releasably attach a digital tuner to a stringed instrument. In particular, the attachment 106 can allow a user to place a digital tuner near the stringed instrument in any desired location. The attachment 106 can be of sufficient strength to ensure that the digital tuner remains in place during use or transport of the stringed instrument.

FIG. 2 shows that the attachment 106 can include a flexible plate 202. The flexible plate 202 is an object that uses negative fluid pressure of air or water to adhere to nonporous surfaces and in the process creates a partial vacuum. For example, the working face of the flexible plate 202 can have a curved surface. When the center of the flexible plate 202 is pressed against a flat, non-porous surface, the volume of the space between the flexible plate 202 and the flat surface is reduced, which causes the fluid between the flexible plate 202 and the surface to be expelled past the rim of the flexible plate 202. When the user ceases to apply physical pressure to the center of the outside of the flexible plate 202, the elastic substance of which the flexible plate 202 is made tends to resume its original, curved shape. Because all of the fluid has already been forced out of the inside of the flexible plate 202, the cavity which tends to develop between the flexible plate 202 and the flat surface has little to no air or water in it, and therefore lacks pressure. The pressure difference between the atmosphere on the outside of the flexible plate 202, and the low-pressure cavity on the inside of the flexible plate 202, is what keeps the flexible plate 202 adhered to the surface.

One of skill in the art will appreciate that the flexible plate 202 can allow an efficient transfer of vibrations from the stringed instrument to the digital tuner 104. In particular, as the flexible plate 202 is attached the rim of the flexible plate 202 is pressed, via vacuum pressure discussed above, to the stringed instrument. This allows the digital tuner 104 to pick up the vibrations and be quite sensitive.

The efficiency of the transfer can be enhanced by a flexible plate 202 with a small diameter. For example, the flexible plate 202 can be circular with a diameter between 28 mm and 44 mm. In particular, the flexible plate 202 can be circular with a diameter of approximately 36 mm. As used in the specification and the claims, the term approximately shall mean that the value is within 10% of the stated value, unless otherwise specified.

FIG. 2 also shows that the attachment 106 can include a knob 204. The knob 204 can be configured to move a portion of the flexible plate 202 relative to the surface of the stringed instrument. I.e., the knob 204 can be moved a first direction to move a portion of the flexible plate 202 away from the stringed instrument, increasing the force required to release the attachment 106. In contrast, the knob 204 can be moved in a second direction, opposite the first direction, which moves the portion of the flexible plate 202 toward the stringed instrument, decreasing the force required to release the attachment 106.

FIG. 2 further shows that the attachment 106 can include a release 206. The release 206 can be configured to allow air into the inside of the flexible plate 202. For example, the release 206 can include a tab for lifting a portion of the rim of the flexible plate 202. Additionally or alternatively, the release 206 can include a plug or other mechanism that can allow air to enter the inside of the flexible plate 202 directly.

FIG. 2 additionally shows that the attachment 106 can include a swivel 208. The swivel 208 can allow the orientation of the digital tuner to be changed relative to the stringed instrument without having to release the flexible plate 202. For example, the swivel 208 can include a 360 degrees swivel or a ball joint that allows the user to change the orientation of the digital tuner to any desired position relative to the stringed instrument. One of skill in the art will appreciate that the swivel 208 need not be present (i.e., the digital tuner can be directly attached to the flexible plate 202) if desired. I.e., if the user does not desire motion of the digital tuner relative to the stringed instrument.

FIG. 2 moreover shows that the attachment 106 can include a non-porous plate 210. The non-porous plate 210 can allow the flexible plate 202 to be attached to the stringed instrument. I.e., the stringed instrument may include a porous surface. This means that air can pass through the surface and the flexible plate 202 may be unable to attach adequately. The non-porous plate 210 can include a nonporous surface that can be permanently attached to the stringed instrument, allowing the flexible plate 202 to have sufficient attachment strength.

Figure 3:
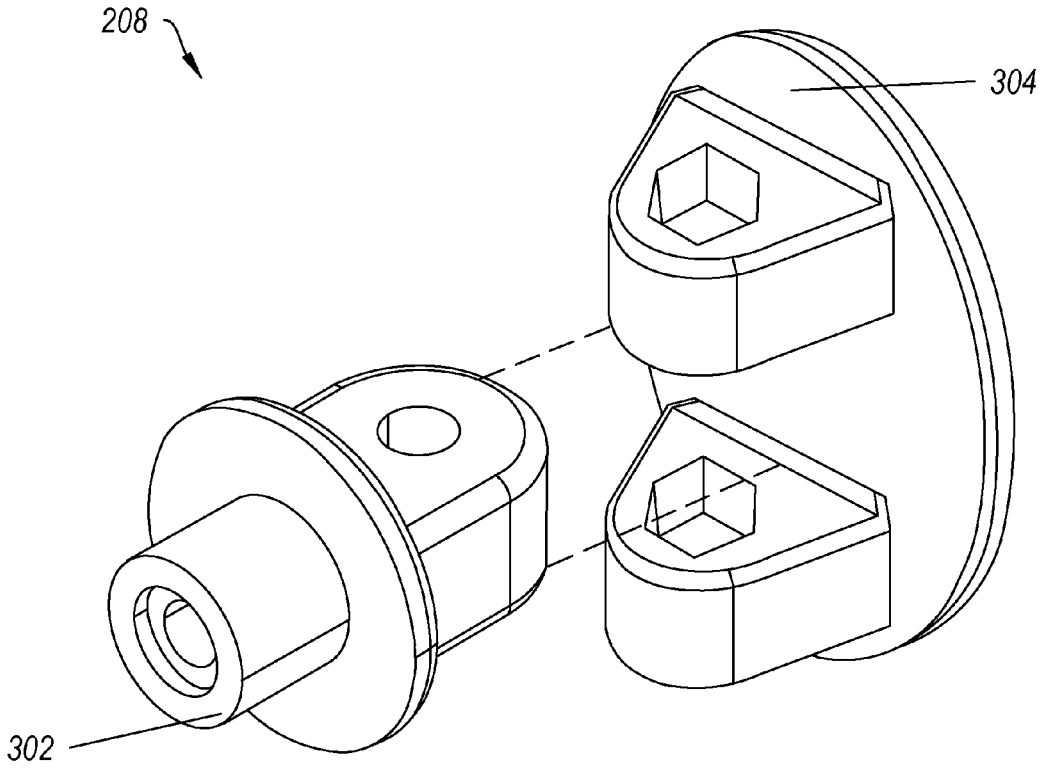
FIG. 3 illustrates an exploded view of an example of a swivel.

FIG. 3 illustrates an exploded view of an example of a swivel 208. The swivel 208 can allow motion of the digital tuner relative to the stringed instrument. In particular, the swivel 208 can allow the orientation of the digital tuner to be adjusted. For example, the user can change the position of the digital tuner during tuning and then place the digital tuner in a more compact use when not in use.

FIG. 3 shows that the swivel 208 can include a first attachment 302. The first attachment 302 can be configured to attach to the digital tuner. Additionally or alternatively, the first attachment 302 can allow the digital tuner to move relative to the swivel 208. I.e., the first attachment 302 can include a hinge or other mechanism which allows movement of the attached digital tuner.

FIG. 3 also shows that the swivel 208 can include a second attachment 304. The second attachment 304 can be configured to attach to attachment. Additionally or alternatively, the second attachment 304 can allow the swivel 208 to move relative to the flexible plate. I.e., the second attachment can include a ball joint or other rotatable mechanism which can allow movement of the swivel 208 relative to the flexible plate.

The first attachment 302 and the second attachment 304 can be connected to one another. This can allow the digital tuner to be placed in multiple orientations relative to the flexible plate. I.e., the first attachment 302 can rotate relative to the digital tuner and the second attachment 304 can rotate relative to the flexible plate. In addition, the connection of the first attachment 302 and the second attachment 304 can allow the connection to act as a hinge point.

Figure 4:
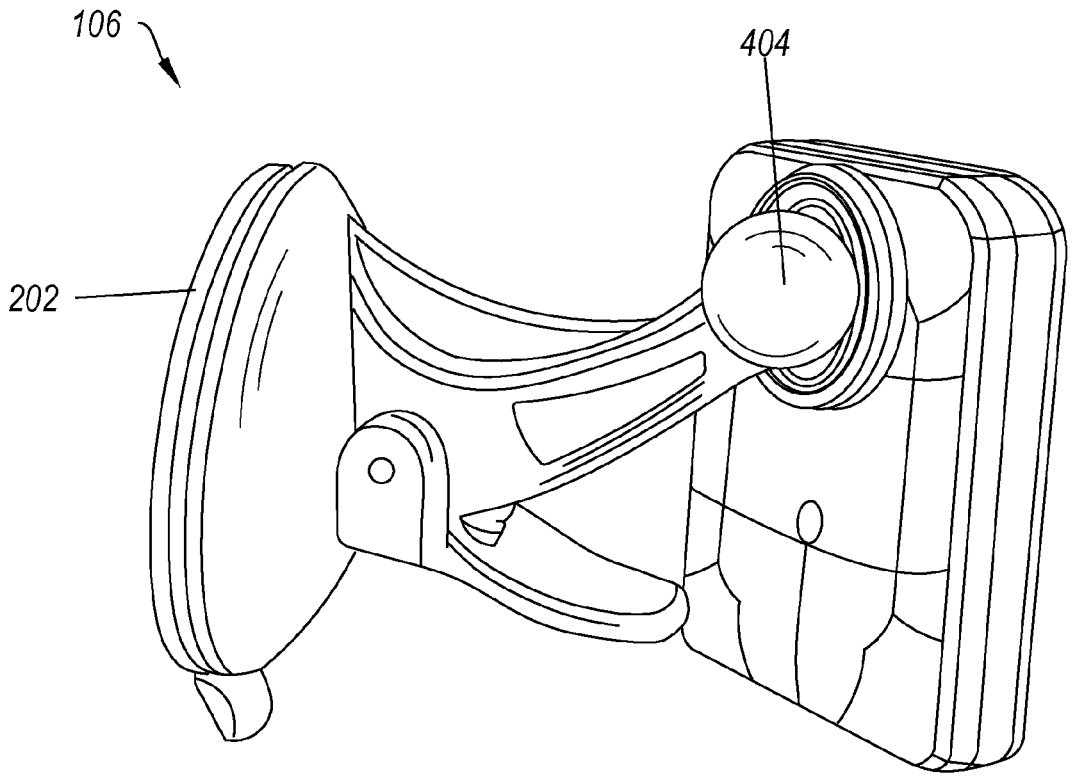
FIG. 4 illustrates an alternative example of an attachment.

FIG. 4 illustrates an alternative example of an attachment 106. The alternative attachment 106 can include a different mechanism for providing sufficient suction on the flexible plate 202. I.e., the alternative attachment 106 can allow the flexible plate to be placed and secured without the use of the knob 204 of FIG. 2.

FIG. 4 shows that the attachment 106 can include a lever 402. The lever 402 can be configured to move a portion of the flexible plate 202 relative to the surface of the stringed instrument. I.e., the lever 402 can be moved a first direction to move a portion of the flexible plate 202 away from the stringed instrument, increasing the force required to release the attachment 106. In contrast, the lever 402 can be moved in a second direction, opposite the first direction, which moves the portion of the flexible plate 202 toward the stringed instrument, decreasing the force required to release the attachment 106.

FIG. 4 also shows that the attachment 106 can include a ball joint 404. The ball joint 404 can include any ball joint configured to allow reorientation of the digital tuner 104. For example, the ball joint 404 can include a tension mounted ball joint. Additionally or alternatively, the ball joint 404 can include a magnetic ball joint.

Figure 5:
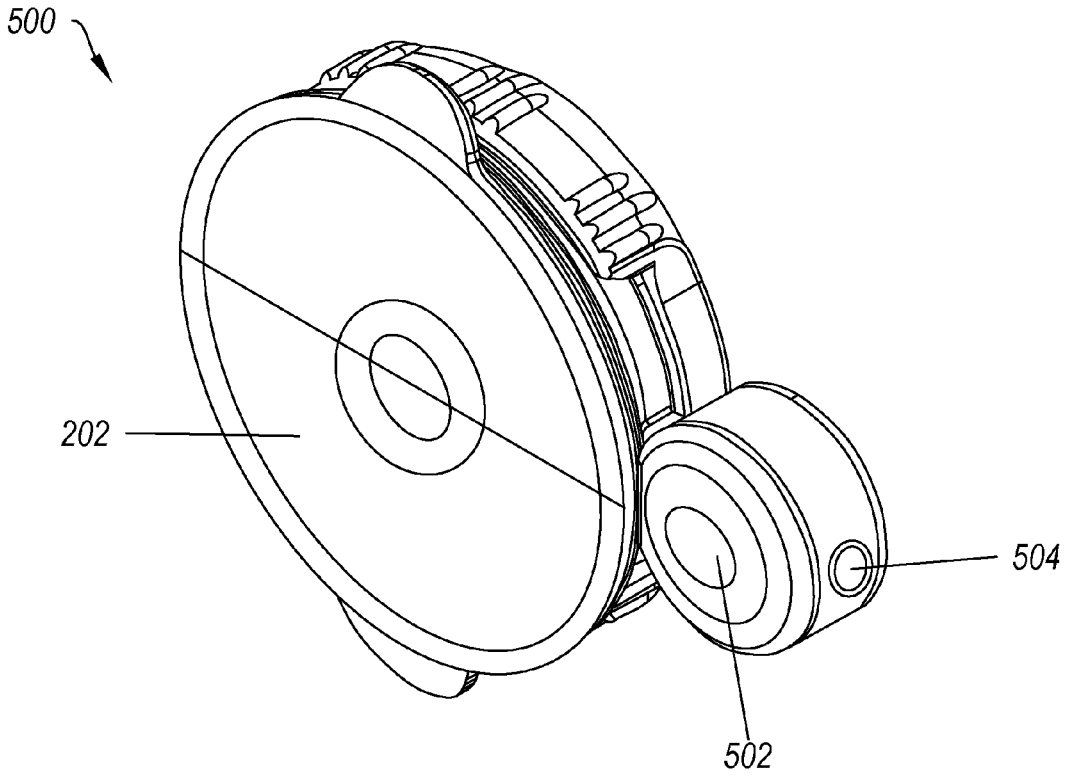
FIG. 5 illustrates an example of a stringed instrument mountable pickup.

FIG. 5 illustrates an example of a stringed instrument mountable pickup 500. A stringed instrument mountable pickup 500 is a transducer that captures mechanical vibrations and converts them to an electrical signal that is amplified, recorded, or broadcast. For example, the stringed instrument mountable pickup 500 can produce an electrical signal which is sent to an amplifier.

FIG. 5 shows that the stringed instrument mountable pickup 500 can include a sensor 502. The sensor 502 can include any device which is configured to detect vibrations produced by the stringed instrument. For example, the sensor 502 can include a piezoelectric sensor, a magnetic sensor a microphone or any other desired device configured to detect the vibrations produced by the stringed instrument. One of skill in the art will appreciate that the sensor 502 can be located anywhere with the stringed instrument mountable pickup 500. For example, the sensor 502 can be located behind the flexible plate 502 or in any other desired location.

FIG. 5 also shows that the stringed instrument mountable pickup 500 can include a jack 504. The jack 504 can be configured to allow an electrical connection between the stringed instrument mountable pickup 500 and an external device. For example, the jack 504 can allow a wire or other connector to be connected to the stringed instrument mountable pickup 500. The external device can include an amplifier, headphones, recording devices or any other desired device.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. A stringed instrument mountable device, the stringed instrument mountable device comprising:

a vibration sensing device configured to detect a note being played on a stringed instrument; and an attachment configured to attach the vibration sensing device to the stringed instrument wherein the attachment includes:

a flexible plate, the flexible plate configured to create a partial vacuum adhering the vibration sensing device to the stringed instrument;

a knob configured to move a portion of the flexible plate relative to the surface of the stringed instrument to adjust the pressure of the partial vacuum;

wherein movement of the knob in a first direction moves a portion of the flexible plate away from the stringed instrument; and wherein movement of the knob in a second direction moves a portion of the flexible plate toward the stringed instrument;

wherein the second direction is opposite the first direction.

2. The string instrument mountable device of claim 1, wherein the vibration sensing device includes a digital tuner.

3. The stringed instrument mountable device of claim 2, wherein the digital tuner includes a LCD display.

4. The stringed instrument mountable device of claim 1 attached to the soundboard of the stringed instrument.

5. The stringed instrument mountable device of claim 1, wherein the flexible plate includes a release configured to allow air into the inside of the flexible plate allowing detachment.

6. The stringed instrument mountable device of claim 5, wherein the release includes a tab on the edge of the flexible plate.

7. The stringed instrument mountable device of claim 1 further comprising a non-porous plate, wherein the non-porous plate includes a nonporous surface that allows attachment of the flexible plate to the stringed instrument.

8. The stringed instrument mountable device of claim 1, wherein the movement of the knob in the first direction decreases the pressure in the partial vacuum increasing the attachment strength.

9. The stringed instrument mountable device of claim 1, wherein the movement of the knob in the second direction increases the pressure in the partial vacuum decreasing the attachment strength.

10. The stringed instrument mountable device of claim 1, wherein the flexible plate is circular with a diameter between 28 mm and 44 mm.

11. The stringed instrument mountable device of claim 10, wherein the diameter of flexible plate is approximately 36 mm.

12. A stringed instrument mountable device, the stringed instrument mountable device comprising:

a vibration sensing device configured to detect a note being played on a stringed instrument; and an attachment including:

a flexible plate configured to create a partial vacuum on the attachment surface of the stringed instrument to releasably secure the vibration sensing device to the stringed instrument;

a knob configured to move a portion of the flexible plate relative to the surface of the stringed instrument to adjust the pressure of the partial vacuum;

wherein movement of the knob in a first direction moves a portion of the flexible plate away from the stringed instrument; and wherein movement of the knob in a second direction moves a portion of the flexible plate toward the stringed instrument;

wherein the second direction is opposite the first direction; and a release configured to allow air into the inside of the flexible plate, preventing attachment.

13. The stringed instrument mountable device of claim 12, wherein the attachment includes a swivel configured to allow the orientation of the vibration sensing device to be changed relative to the stringed instrument.

14. The stringed instrument mountable device of claim 13, wherein the swivel includes an attachment configured to attach the vibration sensing device to the swivel.

15. The stringed instrument mountable device of claim 13, wherein the swivel includes an attachment configured to attach the flexible plate to the swivel.

16. A stringed instrument mountable device, the stringed instrument mountable device comprising:

a vibration sensing device configured to detect a note being played on a stringed instrument; and an attachment including:

a flexible plate configured to:

releasably secure the vibration sensing device to the stringed instrument; and create a partial vacuum adhering the vibration sensing device to the stringed instrument;

a knob configured to move a portion of the flexible plate relative to the surface of the stringed instrument, wherein:

movement of the portion of the flexible plate away from the surface of the stringed instrument decreases the pressure within the partial vacuum allowing attachment; and movement of the portion of the flexible plate toward the surface of the stringed instrument increases the pressure within the partial vacuum allowing detachment;

a release configured to allow air into the inside of the flexible plate, allowing detachment; and a swivel configured to:

allow the orientation of the vibration sensing device to be changed relative to the stringed instrument;

attach to the vibration sensing device; and attach to the flexible plate.

17. The stringed instrument mountable device of claim 16, wherein the vibration sensing device includes a piezoelectric sensor.

* * * * *